US009593921B1

(12) United States Patent
Kostka et al.

(10) Patent No.: US 9,593,921 B1
(45) Date of Patent: Mar. 14, 2017

(54) LARGE CALIBER FRANGIBLE PROJECTILE

(71) Applicant: The United States of America as Represented by the Secretary of the Army, Washington, DC (US)

(72) Inventors: John F. Kostka, Denville, NJ (US); Luis M. Lavrador, Stanhope, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/175,325

(22) Filed: Jun. 7, 2016

Related U.S. Application Data

(62) Division of application No. 14/848,627, filed on Sep. 9, 2015, which is a division of application No. 14/015,079, filed on Aug. 30, 2013, now Pat. No. 9,212,876.

(51) Int. Cl.
*F42B 8/14* (2006.01)
*F42B 12/56* (2006.01)

(52) U.S. Cl.
CPC ..... *F42B 8/14* (2013.01); *F42B 12/56* (2013.01)

(58) Field of Classification Search
CPC .... F42B 5/145; F42B 7/10; F42B 8/12; F42B 8/14; F42B 8/16; F42B 12/04; F42B 12/06; F42B 12/204; F42B 12/22; F42B 12/32; F42B 12/56; F42B 12/58; F42B 12/60; F42B 12/62; F42B 12/625; F42B 12/64
USPC ..... 102/474, 477, 491, 494, 495, 496, 497, 102/498, 506, 529
See application file for complete search history.

(56) References Cited

U.S. PATENT DOCUMENTS 2,356,227 A * 8/1944 Diehl ..... F42B 10/22 102/519
4,016,817 A * 4/1977 Arciniega Blanco ..... F42B 7/10 102/519
4,301,737 A * 11/1981 Yuhash ..... F42B 12/34 102/493
4,649,829 A * 3/1987 Bilsbury ..... F42B 12/06 102/515
4,708,064 A * 11/1987 Bisping ..... F42B 12/06 102/517
4,774,889 A * 10/1988 Wallow ..... F42B 12/06 102/491
4,854,242 A * 8/1989 Katzmann ..... F42B 12/06 102/506
5,088,416 A * 2/1992 Sabranski ..... F42B 12/06 102/506

(Continued)

*Primary Examiner* — Bret Hayes
(74) *Attorney, Agent, or Firm* — Lisa H. Wang

(57) ABSTRACT

A large caliber, frangible, training projectile imitates, for training purposes, the corresponding tactical projectile. To enable fragmentation of the training projectile at impact, some embodiments of the frangible projectile are partially or entirely made of a material with a lower yield strength than the material used in the counterpart tactical projectile. Some embodiments of the frangible projectile may include portions that are sectioned, welded, or provided with stress risers. Some embodiments of the frangible projectile may include high density particles suspended in a weaker medium. The fragmentation methods may be applied to the overall mass of the projectile, or to a portion of the projectile.

12 Claims, 11 Drawing Sheets

(56) References Cited

U.S. PATENT DOCUMENTS

| | | | | |
|---|---|---|---|---|
| 5,388,524 | A * | 2/1995 | Strandli | F42B 8/16 102/506 |
| 6,349,651 | B1 * | 2/2002 | Martinez Garcia | F42B 7/10 102/501 |
| 6,598,536 | B2 * | 7/2003 | Burri | F42B 12/367 102/506 |
| 7,210,410 | B1 * | 5/2007 | Widener | F42B 7/02 102/438 |
| 2005/0109233 | A1 * | 5/2005 | Eches | F42B 12/06 102/489 |
| 2007/0006766 | A1 * | 1/2007 | Kellner | F42B 12/204 102/475 |
| 2008/0307994 | A1 * | 12/2008 | Gustafsson | F41H 11/02 102/489 |
| 2012/0216699 | A1 * | 8/2012 | Fanucci | F42B 12/06 102/473 |
| 2013/0340646 | A1 * | 12/2013 | Eches | F42B 12/06 102/521 |

* cited by examiner

PRIOR ART c
d
A
b
r
14
16
18
20
22
24

LARGE CALIBER FRANGIBLE PROJECTILE

RELATED APPLICATIONS

The present application is a division of, and claims the benefit of, co-pending U.S. patent application Ser. No. 14/848,627, filed Sep. 9, 2015, which is a divisional of, and claims the benefit of U.S. patent application Ser. No. 14/015,079 which issued as U.S. Pat. No. 9,212,876. The specification and drawings of each of these applications are specifically incorporated herein by reference as if set forth in their entirety.

STATEMENT OF GOVERNMENT INTEREST

The inventions described herein may be manufactured, used and licensed by or for the United States Government.

BACKGROUND OF THE INVENTION

The invention relates in general to munitions, and in particular to large caliber, gun-launched projectiles.

Large caliber projectiles are generally 60 mm caliber and larger. Historically, the nose portions of large caliber projectiles have been manufactured from high strength 4340 Steel heat treated to 120 ksi yield strength. The hardened, high strength steel nose renders the projectile susceptible to ricochet. The high strength steel does not fragment on impact and can travel several kilometers after initial impact.

At munitions testing and training sites, berms are used to protect engagement targets and backstops located behind the targets are used to contain the projectiles. In the past, testing and training exercises conducted with high strength steel projectiles were not an issue because the projectiles had a relatively low initial velocity and relatively low mass, resulting in low impact energy. The use of berms and backstops at the testing and training areas was sufficient to protect targets and contain the fired projectiles.

More recently, large caliber projectiles made of high strength steel have higher initial velocity and greater mass. Therefore, the impact energy of the projectiles is greater than in the past. The existing berms and backstops may no longer be sufficient to protect targets and contain fired projectiles. One solution is to expand the area of the Surface Danger Zone (SDZ) at training sites. However, the additional real estate needed for an expanded SDZ is not always readily available. Another solution is to frequently rebuild the berms and backstops at a considerable cost.

A solution is needed to prevent stray projectiles at testing and training areas and to minimize damage to berms and backstops.

SUMMARY OF INVENTION

One aspect of the invention is a frangible training projectile for a large caliber gun. The projectile includes a generally cylindrical base portion and a generally conical portion contiguous with the base portion. The base portion and the conical portion have a common central longitudinal axis and are made of steel having a yield strength of at least 60 ksi. At least three longitudinal slits are formed in the base and conical portions. The slits are equally spaced circumferentially. Each slit extends from a bottom surface of the base portion through the base portion and into the conical portion. Each pair of adjacent slits defines a projectile section therebetween. Upon impact of the projectile, the projectile sections break away from a central core. The projectile may be made from a single monolithic piece of material.

In some embodiments, the number of slits is greater than three and is an odd number.

The radial extent of each slit in the bottom surface may be at least one-half of the radius of the bottom surface. The central core may be substantially a right circular cylinder.

Another aspect of the invention is a frangible training projectile for a large caliber gun wherein the projectile has a generally cylindrical base portion and a generally conical portion adjacent to the base portion. The base portion and the conical portion have a common central longitudinal axis. A rod is centered on the longitudinal axis and extends the entire length of the projectile. The rod has a nose end and a circumferential shoulder formed at the nose end. The base portion includes a bottommost member having an opening for the rod. A plurality of discrete segments are disposed between the bottommost member of the base portion and the circumferential shoulder of the nose end. Upon impact of the projectile, the plurality of discrete segments separates from the rod and the bottommost member of the base portion.

The rod may include at least one circumferential notch formed therein. The opening in the bottommost member may include threads that engage threads on the rod. The number of discrete segments is at least three. The rod, the bottommost member and the plurality of discrete segments may be made of steel having a yield strength of at least 60 ksi.

In one embodiment, each discrete segment may be centered on the common central longitudinal axis and disposed in axial succession from the bottommost member to the nose end of the rod. Each discrete segment may include a central opening through which the rod extends.

Each discrete segment may be an annular disc.

Adjacent discrete segments may include mating interlocking features.

In another embodiment, each discrete segment is a wedge that extends longitudinally from the circumferential shoulder to the bottommost member and radially from an outer surface of the projectile to the rod. The number of wedges is an odd number.

Each pair of adjacent wedges may form a longitudinal abutment line at the outer surface of the projectile, and the projectile may include a weld along at least a portion of each longitudinal abutment line. The wedges and the bottommost member may form a bottom circumferential abutment line at the outer surface of the projectile, and the projectile may include a weld along at least a portion of the bottom circumferential abutment line. The wedges and the circumferential shoulder may form a nose circumferential abutment line at the outer surface of the projectile, and the projectile may include a weld along at least a portion of the nose circumferential abutment line.

In another aspect, the invention encompasses a frangible training projectile for a large caliber gun wherein the projectile has a solid, generally cylindrical base and a hollow cap that is fixed to and closed by the base. The hollow cap has a cylindrical portion, a conical portion, and an interior. The base and the hollow cap have a common central longitudinal axis. A mixture fills the interior of the hollow cap. The mixture includes a plurality of particles dispersed and encapsulated in a rigid potting medium. The particles are made of a material having a density greater than the density of steel. Upon impact of the projectile, the hollow cap separates from the base and the mixture forms a plurality of fragments.

The cylindrical portion of the hollow cap may include internal threads that engage external threads on the base. The base and the hollow cap may be made of steel having a yield strength of at least 60 ksi.

An additional aspect of the invention is a frangible training projectile for a large caliber gun wherein the projectile has a generally cylindrical base portion and a generally conical portion adjacent to the base portion. The base portion and the conical portion have a common central longitudinal axis and are made of steel having a yield strength of at least 60 ksi. A central blind bore is centered on the common central longitudinal axis. The bore begins on a bottom surface of the base portion and extends into the conical portion. Upon impact of the projectile, the conical and base portions form a plurality of fragments.

The projectile may include at least two lateral blind bores having longitudinal axes parallel to the common central longitudinal axis. The at least two lateral blind bores are equally spaced apart circumferentially and located radially the same distance from the common central longitudinal axis. The at least two lateral blind bores begin on the bottom surface of the base portion and extend into the conical portion.

The projectile may include a steel rod disposed in the central blind bore. Steel rods may also be disposed in two or more of the at least two lateral blind bores.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A novel large caliber frangible training projectile breaks up into fragments on impact. The frangible projectile must, however, be strong enough to withstand the large caliber gun environment, including set back forces, pressure, and heat. In general, to withstand the gun environment, the material used to fabricate the novel frangible projectile has a yield strength of at least 60 ksi.

The properties of the frangible training projectile that are important for training purposes are as close as possible to the properties of the corresponding tactical projectile. These properties include one or more of the tactical projectile's weight, center of gravity, length, and external ballistics.

The mass of the frangible projectile is broken into several fragments upon impact. The fragmentation reduces the projectile velocity, increases its surface area and increases its resistance to movement. The fragmentation results in a reduction of projectile energy. The frangible training projectile will limit the SDZ as well as minimize damage to berms and backstops.

To enable fragmentation at impact, some embodiments of the frangible projectile are partially or entirely made of a material with a lower yield strength than the material used in the counterpart tactical projectile. Some embodiments of the frangible projectile may include portions that are sectioned, welded, or provided with stress risers. Some embodiments of the frangible projectile may include high density particles suspended in a weaker medium. These fragmentation methods may be applied to the overall mass of the projectile, or to a portion of the projectile, such as the portion with the largest mass of the projectile. The portion with the largest mass may be, in some cases, the nose of the projectile.

Figure 1:
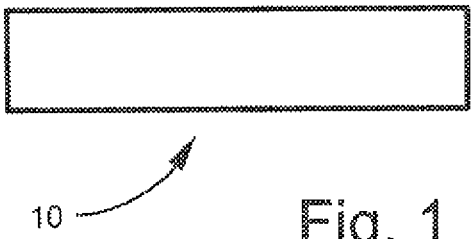
FIG. 1 is a schematic drawing of a large caliber gun for launching projectiles.
Figure 2:
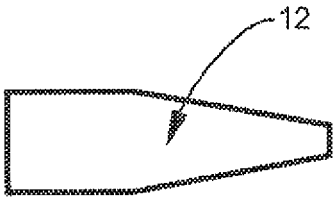
FIG. 2 is a side view of a large caliber projectile.
Figures 3A, 3B, 3C, 3D:
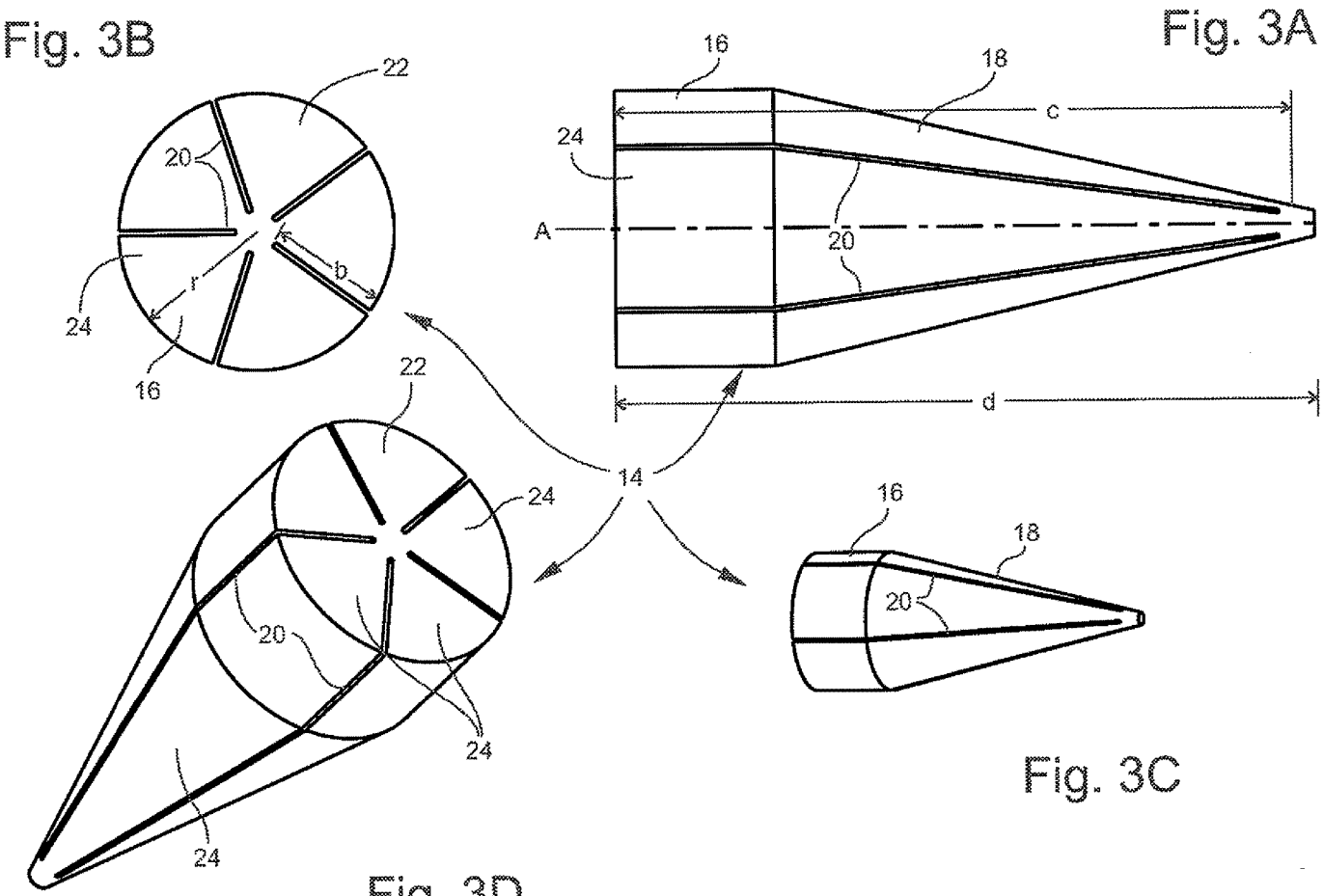
FIGS. 3A-D are side, end, perspective side, and perspective end views, respectively, of one embodiment of a large caliber frangible projectile.

FIG. 1 is a schematic drawing of a large caliber gun 10 for launching projectiles. FIG. 2 is a side view of a large caliber tactical projectile 12 that may be inserted in a munition cartridge and launched from gun 10.

FIGS. 3A-D are side, end, perspective side, and perspective end views, respectively, of one embodiment of a large caliber frangible projectile 14. Projectile 14 includes a cylindrical base portion 16 and a conical portion 18 contiguous with base portion 16. Base portion 16 and conical portion 18 have a common central longitudinal axis A. Base portion 16 and conical portion 18 are made of steel having a yield strength of at least 60 ksi.

At least three longitudinal slits 20 are formed in base and conical portions 16, 18. In FIGS. 3A-D, five slits 20 are shown, although more than five slits may be present. The number of slits should be an odd number. Slits 20 are equally spaced circumferentially in projectile 14. Each slit 20 extends from a bottom surface 22 of base portion 16 through base portion 16 and into conical portion 18. Each pair of adjacent slits 20 defines a projectile section 24 therebetween.

Projectile 14 may be formed from a single monolithic piece of material. Slots 20 may be formed, using, for example, a saw. In some embodiments of projectile 14, the radial extent b of each slit 20 measured from the perimeter of bottom surface 22 inwardly toward the center of bottom surface 22 is at least one-half of the radius r of bottom surface 22. As shown in FIGS. 3A-D, the radial extent b is at least 75% of the radius r. In some embodiments of projectile 14, the axial extent c of each slit 20 is at least one-half the length d of projectile 14. As shown in FIGS. 3A-D, the axial extent c is at least 75% of the length d.

Figures 4A, 4B:
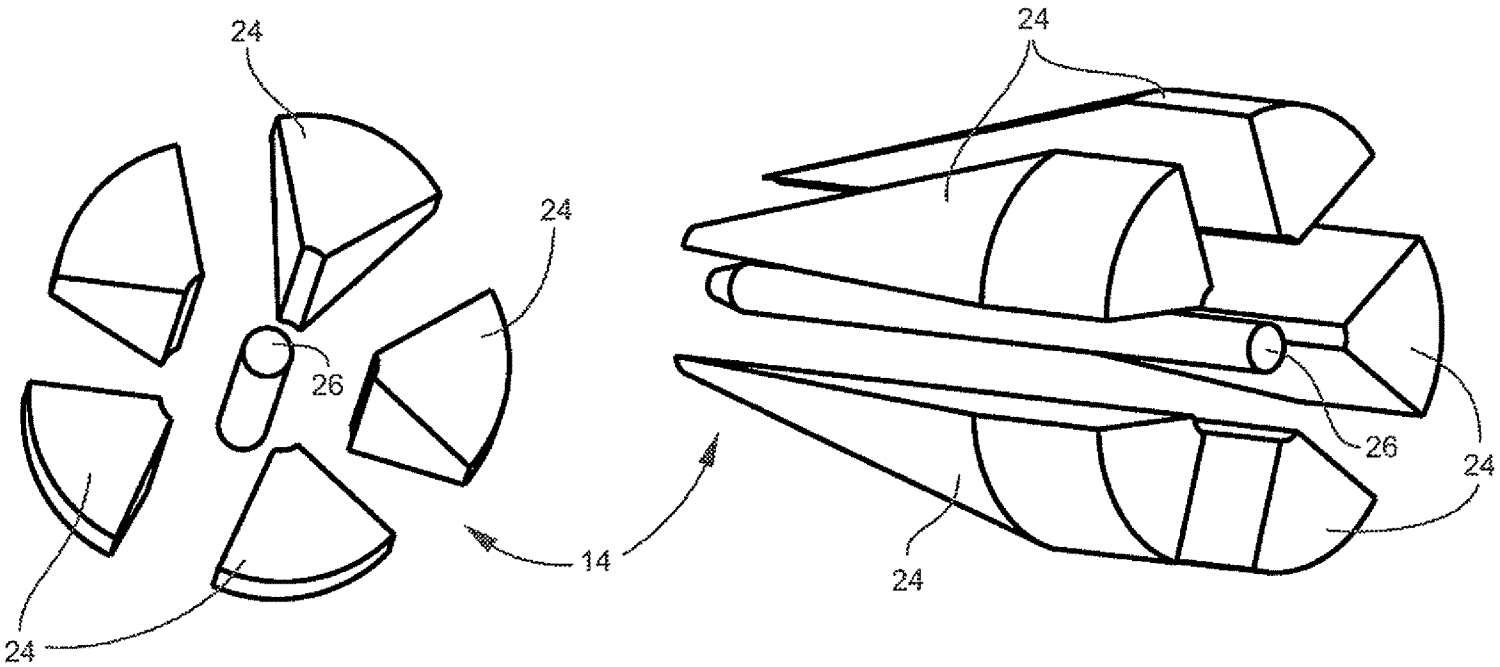
FIGS. 4A and 4B are perspective views of the projectile of FIGS. 3A-D after impact.

FIGS. 4A and 4B are perspective views of projectile 14 after impact. Upon impact of projectile 14, projectile sections 24 break away from a central core 26. Preferably, central core 26 is a right circular cylinder or substantially a right circular cylinder.

Figure 5A:
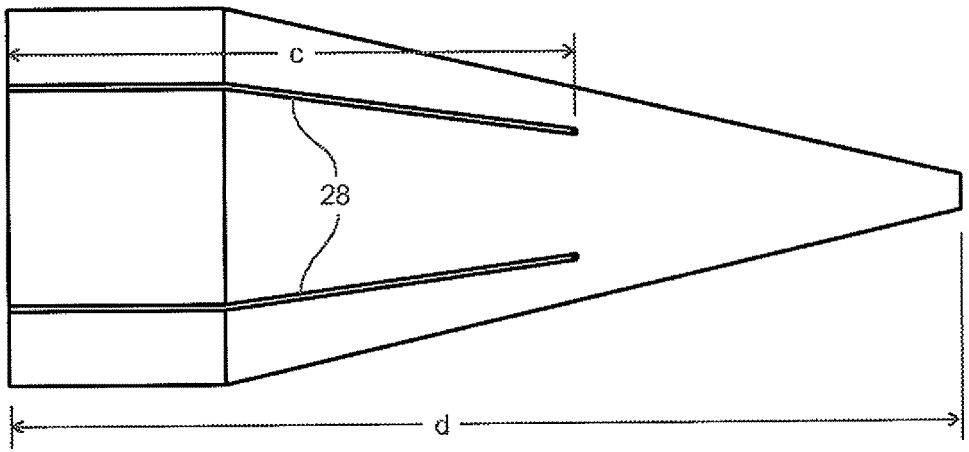
FIGS. 5A-C are side, end, and perspective views, respectively, of an embodiment of a large caliber frangible projectile.
Figure 5B:
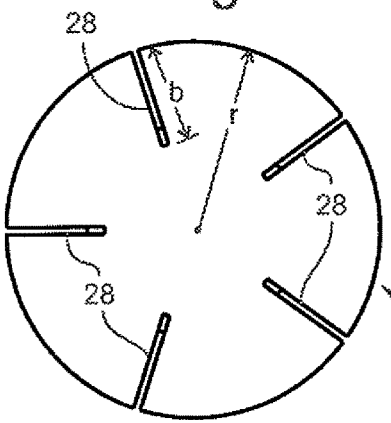
Figure 5C:
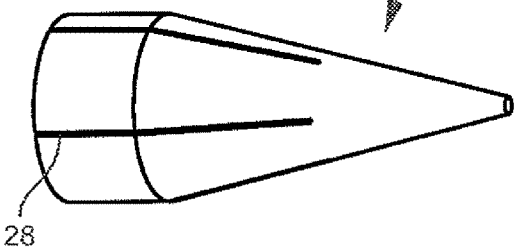

FIGS. 5A-C show a variation of projectile 14 with slits 28. Compared to slits 20, slits 28 have less radial extent b and less axial extent c. Slits 28 may be cut, for example, with a circular saw. The use of a circular saw may produce slits 28 with a varying radial extent b.

Figure 6B:
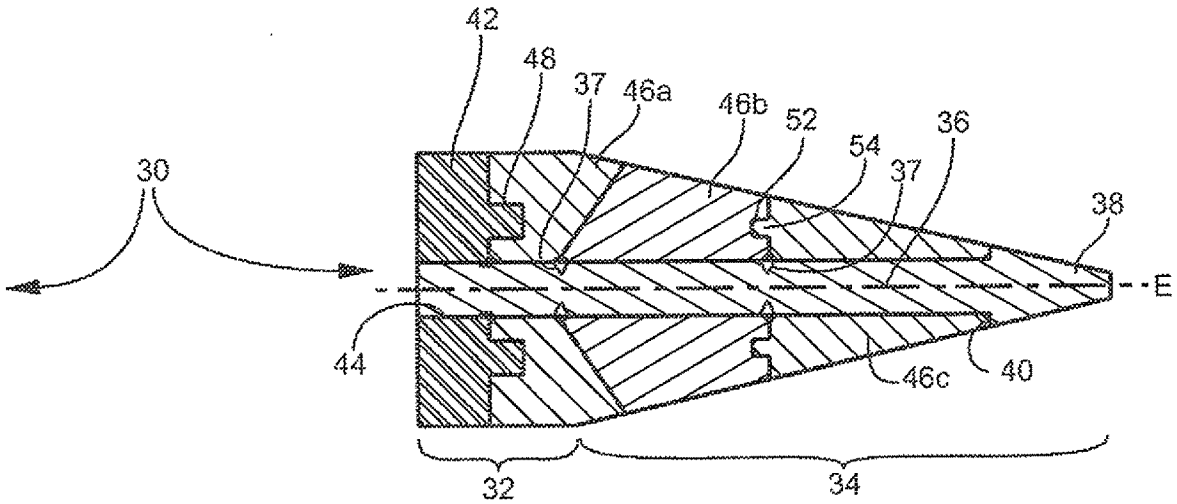
FIG. 6B is a sectional view along the line 6B-6B of FIG. 6A.
Figure 6A:
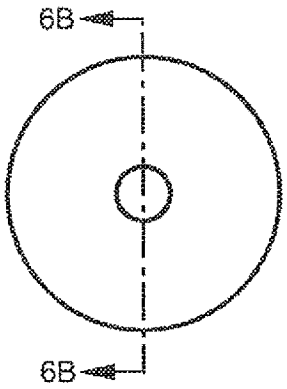
FIG. 6A is an end view of a large caliber frangible projectile.

FIGS. 6A-B show another large caliber frangible projectile 30. Projectile 30 has a generally cylindrical base portion 32 and a generally conical portion 34 adjacent to base portion 32. Base portion 32 and conical portion 34 have a common central longitudinal axis E. A rod 36 is centered on longitudinal axis E and extends the entire length of projectile 30. Rod 36 has a nose end 38 and a circumferential shoulder 40 formed at nose end 38. Rod 36 may include one or more circumferential notches 37 formed therein. Base portion 32 includes a bottommost member 42 having a threaded opening 44 that engages threads on rod 36. A plurality of discrete segments 46 are disposed between bottommost member 42 of base portion 32 and circumferential shoulder 40 of nose end 38. The number of discrete segments 46 is at least three and may be more than three.

Upon impact of projectile 30, rod 36 will break. The discrete segments 46 will separate from each other, from rod 36, and from bottommost member 42. The use of notches 37 will cause rod 36 to more easily break.

In some embodiments, rod 36, bottommost member 42 and the plurality of discrete segments 46 are made of steel having a yield strength of at least 60 ksi.

In FIGS. 6A-B, each discrete segment 46*a*, 46*b*, 46*c* is centered on common central longitudinal axis E and is disposed in axial succession from bottommost member 42 to nose end 38 of rod 36. Each discrete segment 46*a*, 46*b*, 46*c* includes a central opening through which rod 36 extends. Adjacent discrete segments 46 may include interlocking features. For example, segment 46*a* includes slots 48 that mate with projections 50 on bottommost member 42. Segments 46*a* and 46*b* have mating angled contact surfaces. Segment 46*b* includes slots 52 that mate with projections 54 on segment 46*c*.

Figure 7:
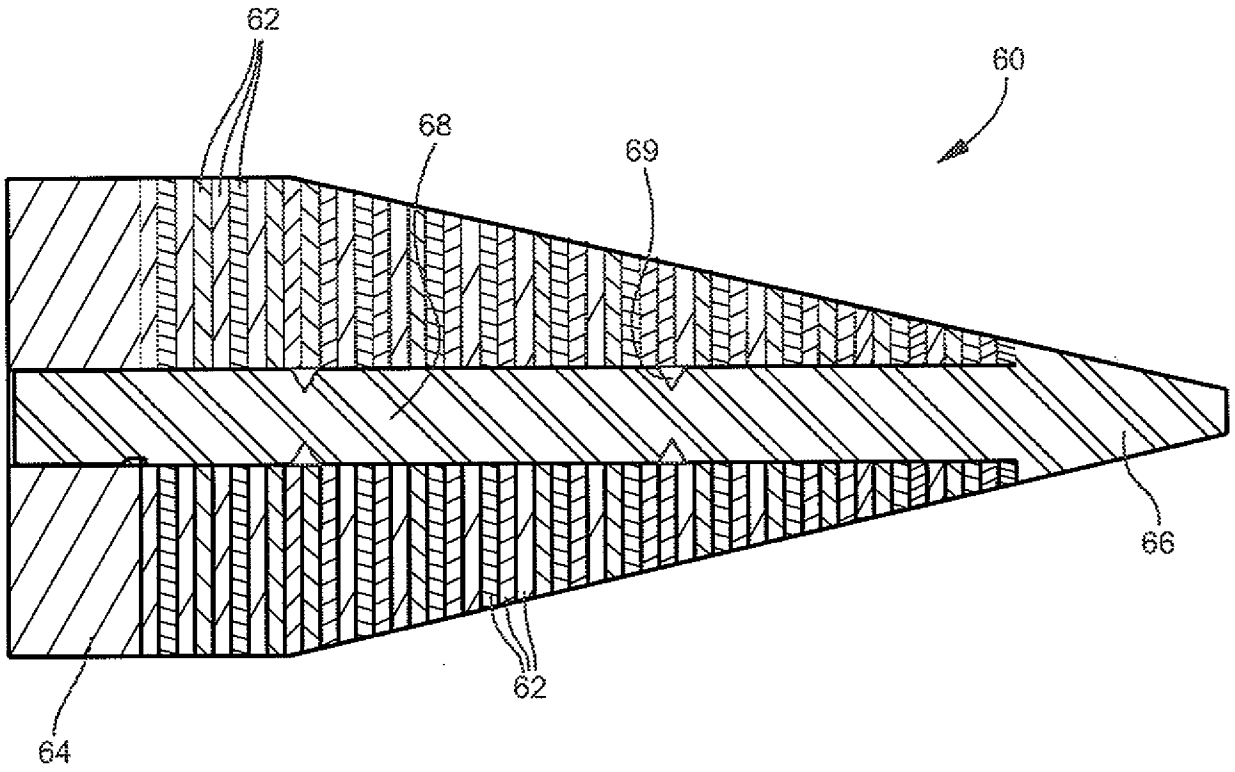
FIG. 7 is a longitudinal sectional view of a large caliber frangible projectile.

FIG. 7 shows a large caliber frangible projectile 60 similar to projectile 30. In projectile 60, each discrete segment between bottommost member 64 and nose end 66 is an annular disc 62. Rod 68 may include one or more circumferential notches 69 formed therein.

Figures 8A, 8B, 8C:
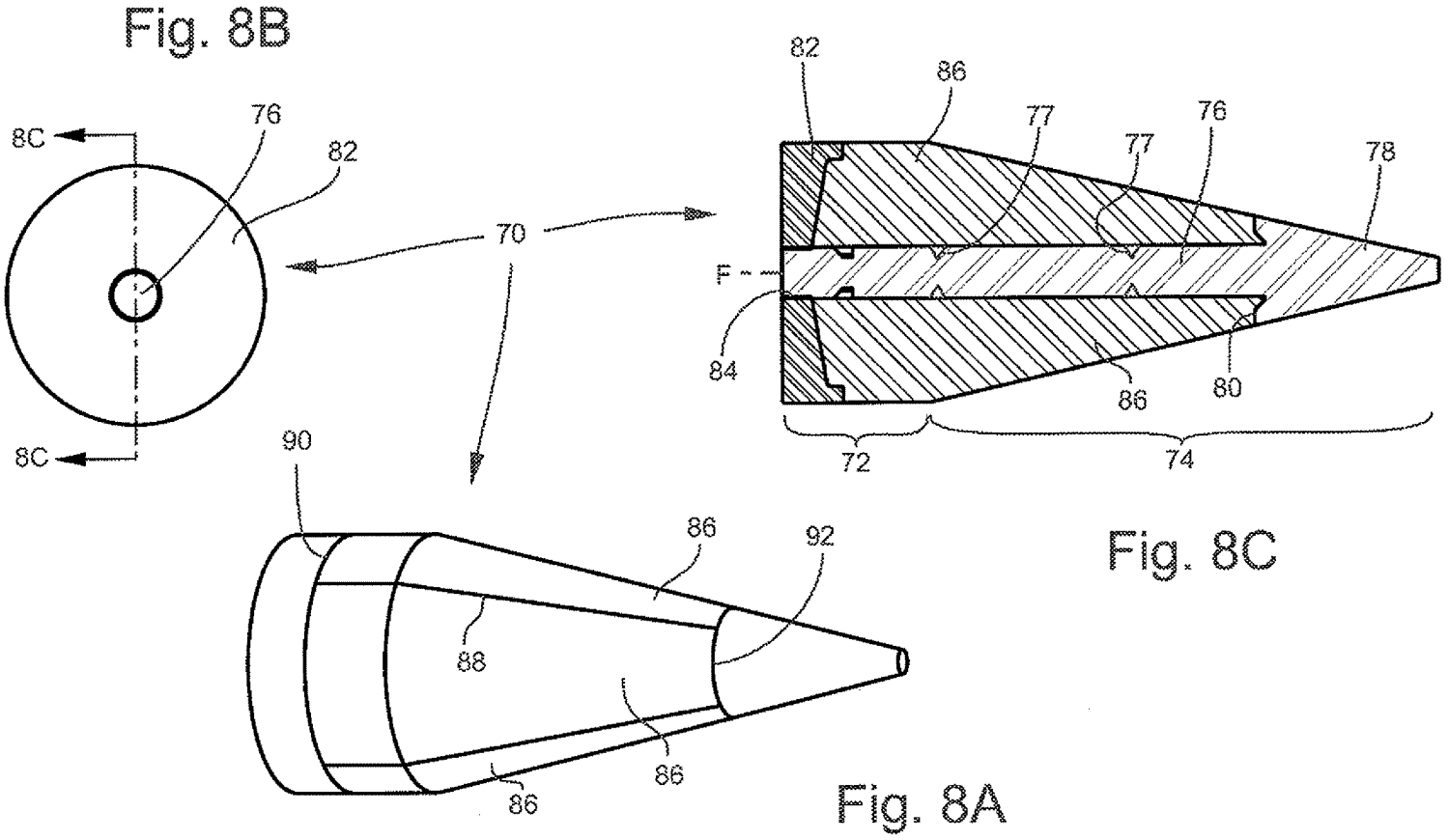
FIGS. 8A and 8B are perspective and end views, respectively, of a large caliber frangible projectile.
FIG. 8C is a sectional view along the line 8C-8C of FIG. 8B.

FIGS. 8A-C show a large caliber frangible projectile 70 having a generally cylindrical base portion 72 and a generally conical portion 74 adjacent to base portion 72. Base portion 72 and conical portion 74 have a common central longitudinal axis F. A rod 76 is centered on longitudinal axis F and extends the entire length of projectile 70. Rod 76 has a nose end 78 and a circumferential shoulder 80 formed at nose end 78. Rod 76 may include one or more circumferential notches 77 formed therein. Base portion 72 includes a bottommost member 82 having a threaded opening 84 that engages threads on rod 76. A plurality of discrete segments 86 are disposed between bottommost member 82 of base portion 72 and circumferential shoulder 80 of nose end 78. The number of discrete segments 86 is at least three and may be an odd number more than three.

In projectile 70, each discrete segment 86 is a wedge that extends longitudinally from circumferential shoulder 80 to bottommost member 82 and radially from the outer surface of projectile 70 inwardly to rod 76. Upon impact of projectile 70, rod 76 will break. The discrete segments 86 will separate from each other, from rod 76, and from bottommost member 82. The use of notches 77 may enable rod 76 to break more easily.

Each pair of adjacent wedge segments 86 forms a longitudinal abutment line 88 at the outer surface of projectile 70. The wedge segments 86 and bottommost member 82 form a bottom circumferential abutment line 90 at the outer surface of projectile 70. The wedge segments 86 and circumferential shoulder 80 form a nose circumferential abutment line 92 at the outer surface of projectile 70.

In some embodiments of projectile 70, adjacent wedge segments 86 may be welded together along all or a portion of longitudinal abutment lines 88; wedge segments 86 and bottommost member 82 may be welded together along all or a portion of bottom circumferential abutment line 90; and wedge segments 86 and rod 76 may be welded together along all or a portion of nose circumferential line 92. Upon impact of projectile 70, the welds on the abutment lines will break and segments 86 will separate from each other and from rod 76 and bottommost member 82.

Figure 9:
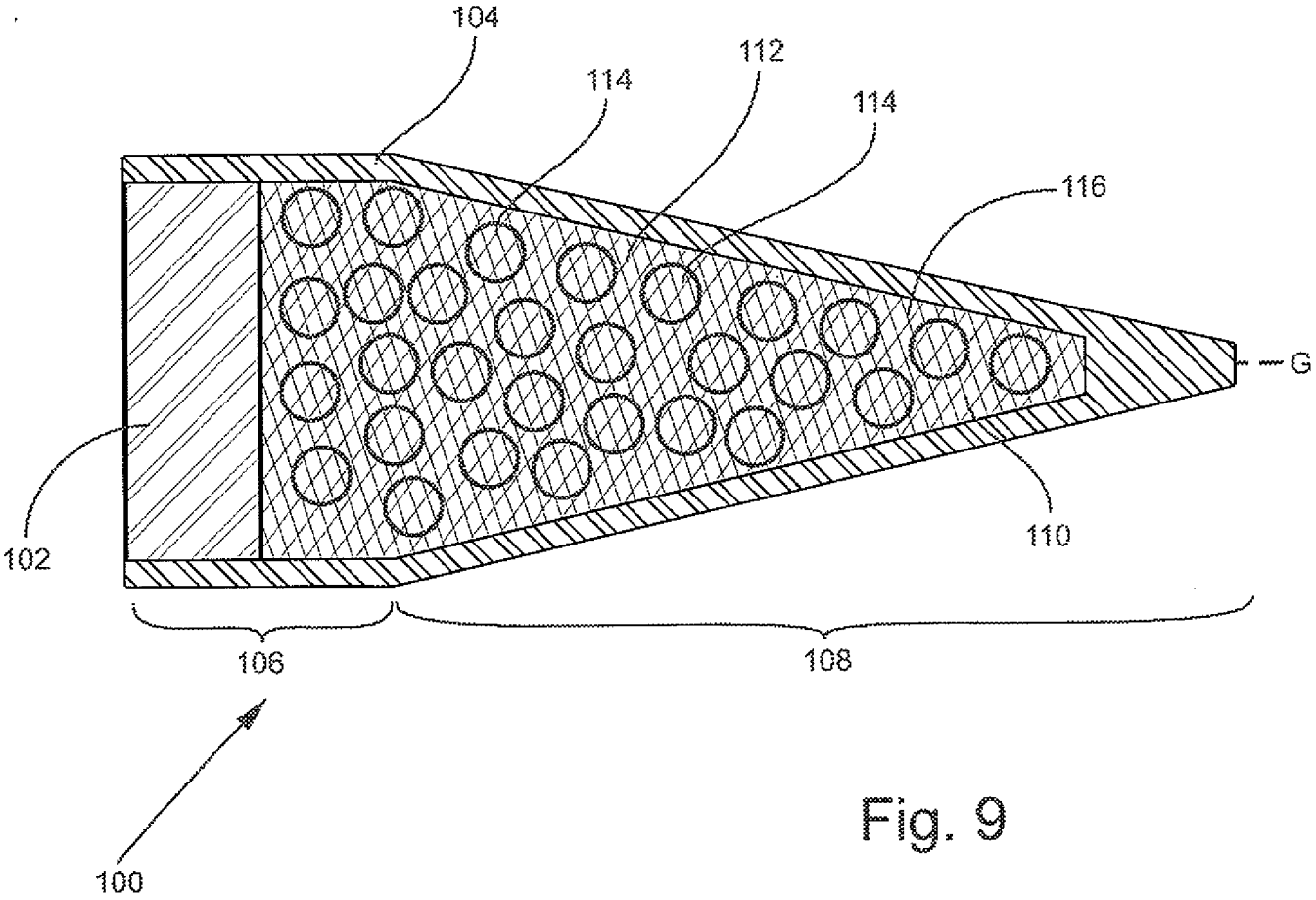
FIG. 9 is a longitudinal sectional view of a large caliber frangible projectile.

FIG. 9 is a longitudinal sectional view of a large caliber frangible projectile 100. Projectile 100 includes a solid, generally cylindrical base 102 and a hollow cap 104 that is fixed to and closed by base 102. Hollow cap 104 has a cylindrical portion 106, a conical portion 108, and an interior 110. Cylindrical portion 106 of hollow cap 104 includes internal threads that engage external threads on base 102. Base 102 and hollow cap 104 have a common central longitudinal axis G. Base 102 and hollow cap 104 may be made of steel having a yield strength of at least 60 ksi.

A mixture 112 fills interior 110 of hollow cap 104. Mixture 112 includes a plurality of particles 114 dispersed and encapsulated in a rigid potting medium 116. An example of a potting medium is epoxy. Particles 114 are made of a material having a density greater than the density of steel, for example, tungsten or lead or other dense materials. One preferred shape for particles 114 is spherical. Upon impact of projectile 100, hollow cap 104 separates from base 102 and mixture 112 forms a plurality of fragments. Mixture 112 will easily fragment on impact because potting medium 116 is a relatively weak material compared to particles 114.

Figures 10A, 10B, 10C:
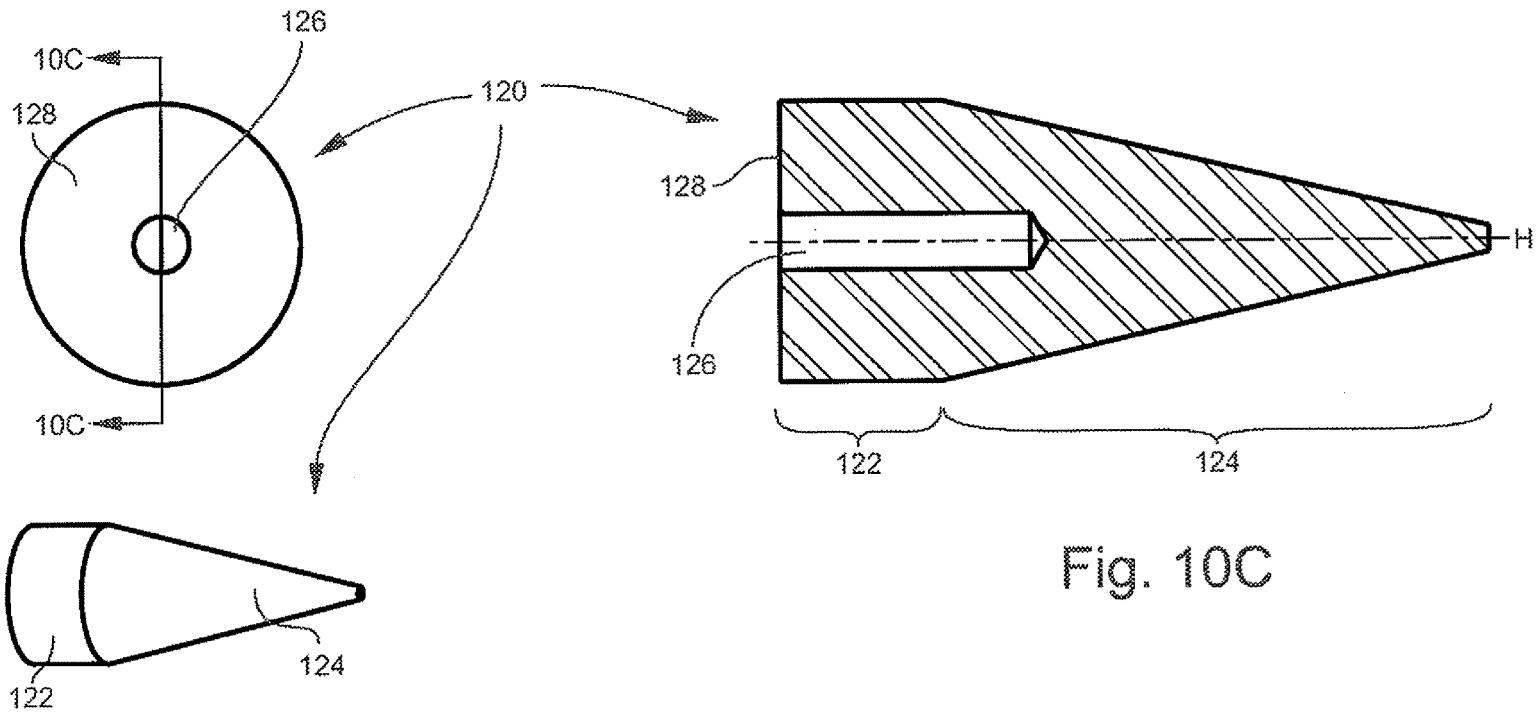
FIGS. 10A and 10B are perspective and end views, respectively, of a large caliber frangible projectile.
FIG. 10C is a sectional view along the line 10C-10C of FIG. 10B.

FIGS. 10A-C show a large caliber frangible projectile 120 having a generally cylindrical base portion 122 and a generally conical portion 124 adjacent to base portion 122. Base portion 122 and conical portion 124 have a common central longitudinal axis H. Base portion 122 and conical portion 124 are made of steel having a yield strength of at least 60 ksi. A central blind bore 126 is centered on common central longitudinal axis H. Bore 126 begins on a bottom surface 128 of base portion 122 and extends into conical portion 124. Material, for example, a rod (not shown), may be disposed in central blind bore 126. Upon impact of projectile 120, conical and base portions 124, 122 form a plurality of fragments.

Figure 11B:
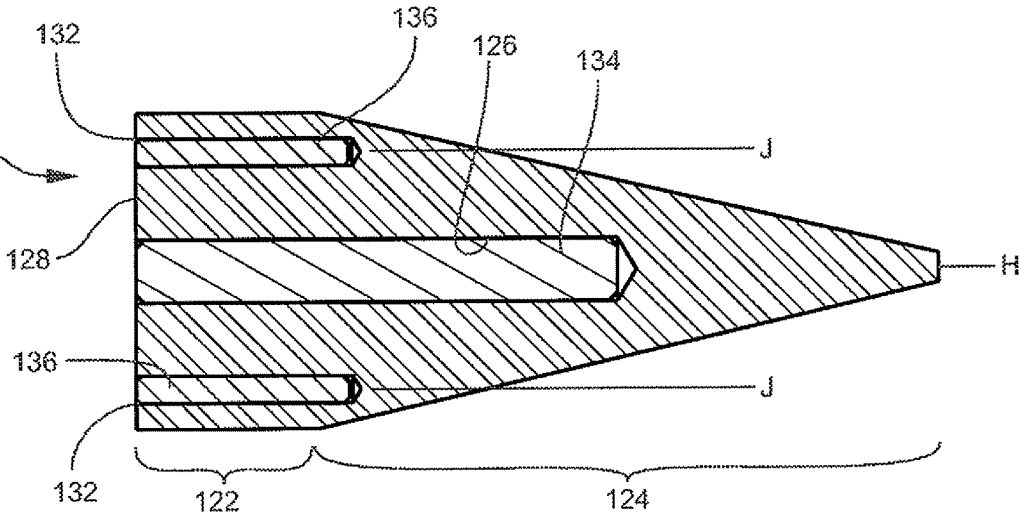
FIG. 11B is a sectional view along the line 11B-11B of FIG. 11A.
Figure 11A:
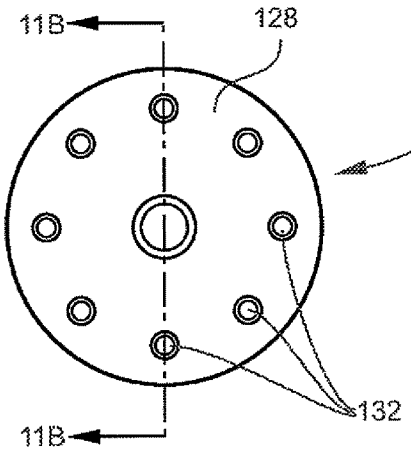
FIG. 11A is an end view of a large caliber frangible projectile.

FIGS. 11A-B show a large caliber frangible projectile 130 that is similar to projectile 120. Projectile 130 differs from projectile 120 by the addition of at least two lateral blind bores 132. Six lateral blind bores 132 are shown in FIGS. 11A-B. Lateral blind bores 132 have longitudinal axes J parallel to common central longitudinal axis H. Blind bores 132 are equally spaced apart circumferentially and located radially the same distance from common central longitudinal axis H. Lateral blind bores 132 begin on a bottom surface 128 of base portion 122 and extend into conical portion 124.

Central blind bore 126 may extend axially over half the overall length of projectile 130. Lateral blind bores 132 are preferably all the same diameter and length. The diameter of lateral blind bores 132 is less than the diameter of central blind bore 126. A rod 134 may be disposed in central blind bore 126. Rod 134 may be made of, for example, steel. Rods 136 may be disposed in pairs of radially opposite lateral blind bores 132. Rods 136 may be made of, for example, steel.

Figure 12C:
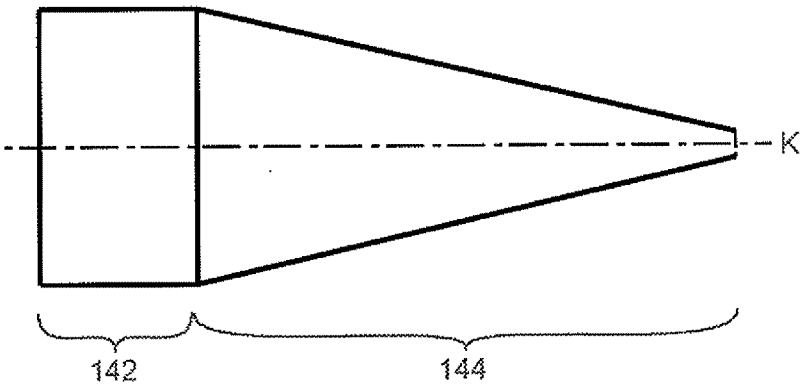
FIGS. 12A-C are perspective, end, and side views, respectively, of a large caliber frangible projectile.
Figure 12B:
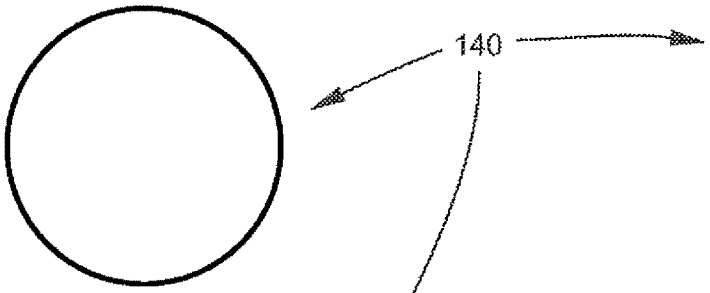
Figure 12A:
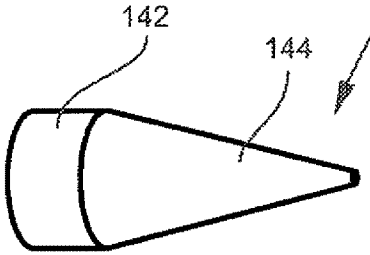

FIGS. 12A-C show a large caliber frangible projectile 140 having a generally cylindrical base portion 142 and a generally conical portion 144 adjacent to base portion 142. Base portion 142 and conical portion 144 have a common central longitudinal axis K. Base portion 122 and conical portion 124 are made of steel having a yield strength of approximately 60 ksi. Projectile 140 will fragment upon impact with a berm or backstop.

While the invention has been described with reference to certain embodiments, numerous changes, alterations and modifications to the described embodiments are possible without departing from the spirit and scope of the invention as defined in the appended claims, and equivalents thereof.

What is claimed is:

1. A frangible training projectile for a large caliber gun, comprising:

a generally cylindrical base portion;

a generally conical portion adjacent to the base portion, the base portion and the conical portion having a common central longitudinal axis;

a rod centered on the longitudinal axis and extending an entire length of the projectile, the rod having a nose end and a circumferential shoulder formed at the nose end and wherein the rod includes at least one circumferential notch formed therein;

the base portion including a bottommost member having an opening for the rod; and a plurality of discrete segments disposed between the bottommost member of the base portion and the circumferential shoulder of the nose end;

wherein, upon impact of the projectile, the plurality of discrete segments separates from the rod and the bottommost member of the base portion.

2. The projectile of claim 1, wherein the opening in the bottommost member includes threads that engage threads on the rod.

3. The projectile of claim 1, wherein a number of the discrete segments is at least three.

4. The projectile of claim 3, wherein each discrete segment is centered on the common central longitudinal axis and disposed in axial succession from the bottommost member to the nose end of the rod, each discrete segment including a central opening through which the rod extends.

5. The projectile of claim 4, wherein each discrete segment is an annular disc.

6. The projectile of claim 4, wherein adjacent discrete segments include mating interlocking features.

7. The projectile of claim 3, wherein each discrete segment is a wedge that extends longitudinally from the circumferential shoulder to the bottommost member and radially from an outer surface of the projectile to the rod.

8. The projectile of claim 7, wherein the number of wedges is an odd number.

9. The projectile of claim 8, wherein each pair of adjacent wedges forms a longitudinal abutment line at the outer surface of the projectile, the projectile further comprising a weld along at least a portion of each longitudinal abutment line.

10. The projectile of claim 9, wherein the wedges and the bottommost member form a bottom circumferential abutment line at the outer surface of the projectile, the projectile further comprising a weld along at least a portion of the bottom circumferential abutment line.

11. The projectile of claim 10, wherein the wedges and the circumferential shoulder form a nose circumferential abutment line at the outer surface of the projectile, the projectile further comprising a weld along at least a portion of the nose circumferential abutment line.

12. The projectile of claim 1, wherein the rod, the bottommost member and the plurality of discrete segments are made of steel having a yield strength of at least 60 ksi.

* * * * *